United States Patent [19]

Seglin et al.

[11] 3,968,052

[45] *July 6, 1976

[54] SYNTHESIS GAS MANUFACTURE

[75] Inventors: Leonard Seglin, New York, N.Y.; Ralph Tracy Eddinger, Princeton Junction, N.J.

[73] Assignee: Cogas Development Company, Princeton, N.J.

[ * ] Notice: The portion of the term of this patent subsequent to Nov. 26, 1991, has been disclaimed.

[22] Filed: May 30, 1974

[21] Appl. No.: 474,417

Related U.S. Application Data

[63] Continuation-in-part of Ser. No. 114,642, Feb. 11, 1971, Pat. No. 3,850,839.

[52] U.S. Cl. ..... 252/373

[51] Int. Cl.[2] ..... C10J 3/46; C10F 3/54

[58] Field of Search ..... 252/373; 48/202, 197

[56] References Cited

UNITED STATES PATENTS

| | | | |
|---|---|---|---|
| 2,657,501 | 11/1953 | Mayland | 48/202 |
| 2,714,059 | 7/1955 | Bearer | 48/197 R |
| 2,729,552 | 1/1956 | Nelson et al. | 48/197 |
| 2,738,262 | 3/1956 | Benz et al. | 48/197 R X |
| 3,115,394 | 12/1963 | Gorin et al. | 48/202 |
| 3,140,241 | 7/1964 | Work et al. | 201/5 |
| 3,375,175 | 3/1968 | Eddinger et al. | 201/31 |
| 3,440,177 | 4/1969 | Patton et al. | 423/650 X |
| 3,847,566 | 11/1974 | Wilson | 252/373 |
| 3,850,839 | 11/1974 | Seglin et al. | 252/373 |

*Primary Examiner*—Howard T. Mars

[57] ABSTRACT

Synthesis gas is prepared by contacting coal-derived char particles with steam in a fluid-bed gasifier wherein heat for the endothermic reaction is supplied by passing through the gasifier a stream of inert pellets heated externally of the gasifier. The pellets, after leaving the gasifier, are separated from entrained char, and then conveyed into a heater where the fines from the external cyclone of the gasifier are burned in the presence of the circulating pellets to produce the heat necessary for the reaction.

4 Claims, 2 Drawing Figures

SYNTHESIS GAS MANUFACTURE

CROSS REFERENCE TO RELATED APPLICATION

This application is a continuation-in-part of our application Ser. No. 114,642, filed Feb. 11, 1971, now U.S. Pat. No. 3,850,839, issued Nov. 26, 1974.

This invention relates to the production of synthesis gas. It is particularly concerned with providing heat requirements in a fluid-bed gasification system of producing synthesis gas.

The gasification of carbonaceous solids with steam to produce a synthesis gas containing high concentrations of hydrogen and carbon monoxide has been practiced for many years. In fact, it is one of the classic processes of the fuel industry. Known as the water gas reaction, it can be depicted by the following idealized equation:

$$C + H_2O \xrightarrow{1600^\circ F} CO + H_2$$

In the large-scale manufacture of synthesis gas, one of the chief difficulties is providing sufficient heat to sustain the highly endothermic reaction. Probably no other single aspect of the process has so engaged the attention and efforts of fuel technologists. Although many solutions have been proposed in dealing with this long-standing problem, a completely satisfactory solution has yet to be found.

Commercial gasification of solid fuel began during the latter half of the 19th century with the development of the fixed-bed process. In this approach, a bed of carbonaceous solid, usually coke, is heated red hot by partial combustion, followed by introduction of the steam until the endothermic heat has slowed the reaction (or cooled the bed below the reaction temperature). The bed is again blasted with air, followed by steam, and the cycles repeated.

During the 1920's, fluidized-bed technology was applied to gasification on a commercial scale and generally has displaced the older fixed-bed system. Although fluid-bed gasification of carbonaceous solids has been extensively developed, the provision of reaction heat, particularly in commercial installations, continues to be a problem. One of the more recent approaches to this difficulty involves the withdrawal of a recycle stream from the gasification bed, and its partial combustion to raise its temperature to such a point that, on recycle back to the reactor along with fresh carbonaceous solids, it provides a substantial portion of the necessary heat of reaction. Such a scheme is illustrated, for example, in Patton et al. U.S. Pat. No. 3,440,177, issued Apr. 22, 1969.

Unfortunately, excess attrition of the carbonaceous solids occurs in such recycle streams resulting in the generation of fines which tend to be blown out of the synthesis gas reactor with the synthesis gas along with the fines produced in the reactor by breakdown of char particles due to reaction with steam. The fines either are lost or must be recovered and returned to the process at some expense. In addition, the build-up of fines necessitates reduction in gas velocity in the reactor, thereby reducing over-all throughput.

In our copending application Ser. No. 50,700, filed June 29, 1970, we describe a technique whereby the build-up of fines is greatly lessened; the carbonaceous solid is desirably a char obtained by the devolatilization of coal in a fluidized bed. In this process, a recirculating char stream from the gasification zone of the fluid-bed reactor is heated, externally of the zone, with combustion gases derived by burning a portion of the char solids, by utilizing, as a fuel for the production of combustion gases to heat the recirculating char stream, char fines from the process separated from the stream of synthesis gas coming out of the gasification reactor, most preferably by an external cyclone, maintaining contact between the combustion gases and the recycle stream for at least sufficient time to get heat interchange (a fraction of a second), but not more than a few seconds, to minimize chemical reaction between the recycle char and the combustion gases.

Although a decided advance, the process is still plagued with the problem of fines generation due to some attrition of the char in the recycle loop. Manifestly, reduction of fines to an even lower level is a desideratum of the art.

In our copending application Ser. No. 114,642, filed Feb. 11, 1971, we proposed an improvement in the above process, in which the stream of recirculating char is replaced by inert refractory pellets of substantially spherical shape which separate readily from the char, to yield a recirculating stream of inert material free of char, which is then heated by burning the carbonaceous (carbon containing) fines from the external cyclones of the gasifier. As disclosed in said application, the heating is preferably done by contacting the pellets in a fluid-bed with the hot gases from a combustor in which the carbonaceous fines are burned. Alternatively, the pellets may be heated by burning the fines in the presence of the pebbles, either in a fluid-bed or in gas transport.

In stepping up that process from laboratory to pilot plant, we have found that the process as described in our copending application Ser. No. 114,642 was susceptible of further improvement. While almost all of the carbon separates from inert spherical pellets, a small amount may be carried along by the mass of recirculating pellets, which typically are present in a weight ratio of 20 to 1 to 40 to 1 compared to fresh feed. Since the dust from the cyclones is produced in sufficient quantity to provide substantially all the heat necessary for the reaction, such carrying along of carbon represents an economic waste. Moreover, we have ascertained that mixing of the recirculating pellets with the very hot gases from combustion (typically at about 4000°F) resulted in spalling of the pellets and consequent formation of refractory dust, resulting in substantial increases in operating costs for disposal of the dust, and in costs for replacement of pellets.

It has now been discovered that the difficulties aforesaid, attendant the fluid-bed gasification of carbonaceous solids with steam, can be overcome by circulating through the gasifier a stream of heated inert refractory pellets which are not fluidized with the carbonaceous solids and yield their heat of reaction to the process while passing through the fluid-bed, separating entrained carbonaceous solids from the circulating stream after it has passed through the fluid-bed, and then passing the stream, free of entrained carbon, into a heater where the pellets are maintained in suspension, introducing char fines from the external cyclone of the gasifier into the heater along with sufficient oxygen to burn the fines thereby heating the pellets, and recirculating the heated pellets back to the gasifier to provide the heat necessary for gasification.

The present process is an improvement in the known processes for producing synthesis gas from solid carbonaceous materials in a fluid-bed. In such a process, the carbonaceous raw material, ground to a size such that it can be suspended in a gas stream to form a suspended bed of solids surrounded with gas which acts like a fluid, is reacted with steam to produce carbon monoxide and hydrogen. The temperature at which the process goes in the indicated direction depends on the nature and reactivity of the carbonaceous material; it is generally from about 1400°F to about 2000°F, preferably about 1600°F. At these temperatures raw coals will fuse; hence, the solid carbonaceous material is generally a char of some kind — ranging from low-temperature coal chars to cokes derived from coal and petroleum.

In any case, the reaction is endothermic, requiring about 2700 calories per gram of carbon. Part of this heat can be supplied from the superheat put into the steam used in the process, as reactant and as fluidizing gas for the bed of carbonaceous material, but large amounts of additional heat must be supplied. This is generally done by combustion of a portion of the stream of material fed into the process, to produce heat which is used in the process.

In accordance with this invention, this heat is supplied by introducing into the gasification zone a circulating stream of inert, refractory pellets which have been heated by contact with the hot combustion gases produced by burning the char fines which are expelled from the gasifier. The pellets, in passing through the gasification zone, transfer their heat to the reaction system, from whence they are conveyed back to the combustion zone of burning fines to be reheated for another passage through the gasification zone and so on in a continuous stream between the two stations.

Figure 1:
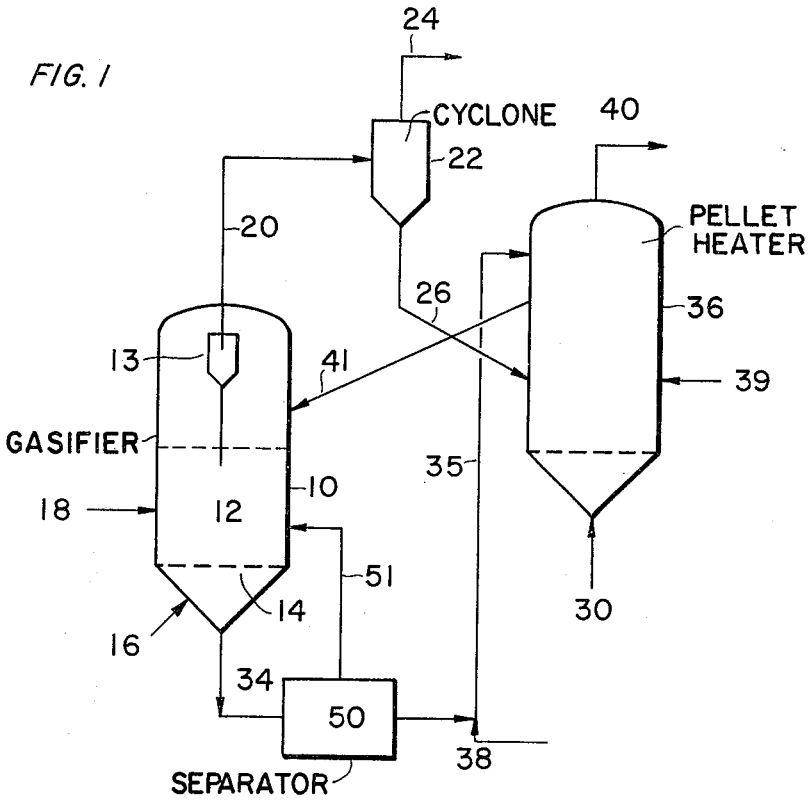
FIG. 1 is a stylized flow sheet of the invention.

Referring to FIG. 1 of the drawing, we provide a gasifier 10 in which a bed 12 of char is maintained on a grid 14 by a fluidizing stream 16 of superheated steam. Carbonaceous material is fed into the bed 12 via entry port 18.

In the gasifier 10, the hot carbonaceous material in the bed 12 reacts with the steam to form synthesis gas, mostly CO and $H_2$, but also containing some $CO_2$ and $H_2O$. These gases, containing entrained solids, pass through internal cyclone 13 and are exhausted through line 20 to external cyclone system 22. The cyclone system may consist of a single unit, but is preferably a series of cyclones. In the cyclone system, the solids entrained in the synthesis gas stream are separated from the stream, which exits from the process through line 24. The larger solids in a complex cyclone system are returned to the reactor, but the finer solids are withdrawn through line 26 to a combination combustion chamber — pellet heater 36.

These solids fed to the heater 36 are the finest solids coming from the fluid-bed gasifier 10, since the synthesis gas stream picks up the fines fraction selectively. By burning them, fines are prevented from building up in the system, thus reducing the load on the cyclone system 22, permitting a smaller capital investment and less maintenance in this area. At the same time, selective removal of the fines stabilizes the size consist of the bed solids, permitting a high throughput of gas without expelling excessive solids from the bed.

The heater 36 also receives a stream of pellets which pass out of the bottom of the gasifier 10 through a line 34 into a separator 50, of any convenient design. Here, any carbon mechanically mixed with the pellets is separated from them, and returned to the gasifier via line 51; the pellets are moved through line 35 into the heater 36 by transport gases entering through line 38.

In the heater 36, the pellets are heated by burning the char fines entering in line 26 with oxygen entering through line 30, preferably in the form of air preheated to 800° to 1000°F. The carbon in the fines burns in the presence of the pellets and heats them from about 1800°F to 2100°F, at which temperature they discharge through line 41 back to the gasifier. The pellets are maintained in fluidized condition in the heater 36 by the air stream 30 used to burn the carbon in the fines. A line 39 is provided for supplying make-up pellets to the process, to replace pellets lost to attrition. The flue gas stream 40, after passing through a dust collection system, may be used as a source of gas for line 38 and may be used to preheat the air in line 30.

Figure 2:
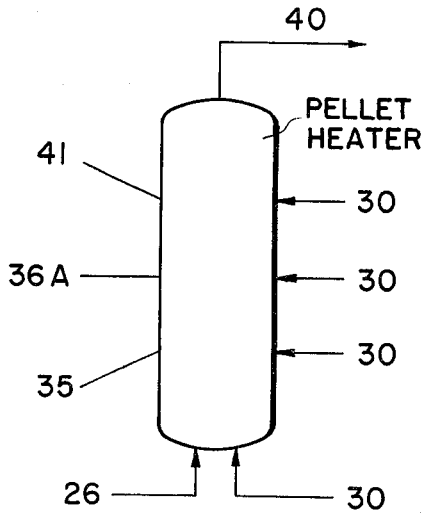
FIG. 2 is a stylized flow sheet showing a modification of the process.

Alternatively, as shown in FIG. 2, the fluid-bed heater-combustor 36 may be replaced by a transport heater-combustor 36A. In this system, the pellets are entrained in combustion gases in very dilute phase — about one-tenth of the concentration in a fluid-bed. The choice of systems used depends on various factors which are not germane to the instant invention.

The use of the separator 50 is essential to the economics of the process. Even spherical particles will carry some carbon with them as they leave the gasifier 10 through line 34. Since carbonaceous dust from the cyclone is generally present in sufficient quantity to provide the heat needed for the circulating pellets, only a very small proportion of carbon in the pellet stream withdrawn from the gasifier will ordinarily mean substantial economic losses, in view of the fact that the stream of pellets is usually 20 to 40 times the weight of fresh carbon coming into the process. Thus, 1% of carbon in the pellet stream means a 20 to 40% carbon removal to the combustor-pellet heater 36. Moreover, the use of the separator 50 permits the use of various-shaped pellets rather than spheres alone, since the less dense carbon can be separated mechanically by proper choice of separating device so long as the pellets are inert.

Burning of the carbonaceous dust in the presence of the pellets is also essential to economic operation. When pellets at 1600°F are exposed to combustion gases of 4000°F, as suggested in our copending application Ser. No. 114,642, a considerable mechanical strain develops in the pellets, inducing weaknesses in the pellets which result in substantially increased attritional losses. By burning the dust in the presence of the pellets, this heat differential and consequent strain in the pellets are avoided, so that attrition losses are minimized.

In the practice of our process, we can use any carbonaceous solid which can be fluidized as a raw material, particularly coal chars and petroleum cokes. Advantageously, we use char such as is produced in accordance with U.S. Pat. No. 3,375,175 to Eddinger et al., issued Mar. 26, 1968, or the calcinate described in U.S. Pat. No. 3,140,241 to Work et al., issued July 7, 1964. The apparatus of the instant invention may be combined with the apparatus of those patents, to increase the over-all yield of fluids from those processes, by gasifying the char resulting therefrom.

The pellets used in the process of the invention are hard, refractory particles of sufficient density whereby they are not fluidized in the gasification zone, but pass downward through the fluidizing bed while transferring their heat content to the reaction. Once the pellets emerge from the bottom of the reactor and through the separator 50, they are swept along by the transport gases back to the pellets heater. The pellets are desirably spheres having a diameter of from about plus 1 1/6 inch to about minus ½ inch depending on their density. An especially convenient and low-cost material is ⅜ inch pelletized, partially vitrified char ash calcined to about 2200°F. In general, the pellets should have a specific heat of from about 0.230 to about 0.275 and a specific gravity of from about 2.20 to about 4.00. The pellets should have a specific gravity at least about 10% greater than the carbonaceous solid so as not to be substantially fluidized therewith. Coal char has a specific gravity of about 0.9–1.3.

The concentration of the pellets in the gasifier depends on the respective residence times of the pellets and of the char in the bed. In general, a weight ratio of pebbles to char about 1 to 1 to 3.5 to 1 is satisfactory.

Examples of suitable pellet material are listed in the following table:

TABLE

| Material | Mean Specific Heat Between 32 and 1800°F, Btu/lb. °F | True Specific Gravity |
|---|---|---|
| Mullite ($3Al_2O_3.2SiO_2$) | 0.245 | 3.00–3.20 |
| Sillimanite ($Al_2O_3.SiO_2$) | 0.270 | 3.2 –3.3 |
| Alumina ($Al_2O_3$) | 0.255 | 3.75–3.95 |
| Periclase | 0.277 | 3.6 –3.9 |
| Pelletized Char Ash | 0.255 | 2.20–2.65 |
| Silicon Carbide | 0.260 | 3.17 |

We have successfully used spherical and cylindrical pellets, and coarse sand with quite varying shapes.

EXAMPLE 940,191 lb/hr of make-up char produced in accordance with U.S. Pat. No. 3,375,175 at 1000°F, containing 13.1% ash (equivalent to 123,010 lb/hr) (stream 18) is combined with 34,500,000 lb/hr of recycle pebbles (stream 41) in a gasifier (10), fluidized with 1,120,135 lb/hr of steam (stream 16). The gasifier (10) operates at 1600°F and 35 psig, and the heat for the gasification reaction (2700 calories per gram carbon):

$$C + H_2O \rightleftarrows CO + H_2 \quad (1)$$

is supplied by recycle pellets, which give up their sensible heat upon cooling from 1900°F, the pellets entering temperature, to 1600°F, the gasifier operating temperature. The water-gas shift reaction $$CO + H_2O \rightleftarrows H_2 + CO_2 \quad (2)$$

also occurs to some extent under the conditions of the gasifier.

The pellets, being denser than the char, sink to the bottom of the bed under the fluidizing action of the steam and product gases. The pellets, in the amount fed (34,500,000 lb/hr) are continuously withdrawn from the bed via stream 34 and through th separator 50, and are moved by transport gases from line 38 back to pebble heater 36. 410,187 lb/hr of char fines (stream 26) are eluted from the gasifier and collected in external cyclone separators and burned with 3,615,235 lb/hr of air preheated to 540°F. These char fines contain the total ash entering with the make-up char, or 123,010 lb/hr.

The product gases (stream 24) from the gasifier are close to the equilibrium for Reactions (1) and (2) above, and contain:

| Compound | lb/hr | Vol.% |
|---|---|---|
| $H_2O$ | 266,374 | 13.9 |
| CO | 1,145,286 | 38.4 |
| $H_2$ | 94,862 | 44.6 |
| $CO_2$ | 143,613 | 3.1 |
| Total | 1,650,135 | 100.0 |

The char fines combust completely to carbon dioxide, thereby heating the recycle pellets to 1900°F. The ash in the make-up char (123,010 lb/hr) is removed from the system by elution out of the fluidized bed by the combustion gases (stream 40). The combustion gases leave at about 1900°F and 35 psig. After removal of dust, heat and power are recovered from these hot combustion gases by sequential passage through a waste boiler, a gas turbine and finally an air preheater.

What is claimed is:

1. In the process of making synthesis gas by the gasification of a solid consisting primarily of carbon with steam in a fluidized-bed gasification zone which is connected to a dust recovery zone, in which the heat for the process is provided by a recirculating stream of recycle solids which are heated by the combustion of the carbon-containing fines collected from the dust recovery zone of the fluidized-bed gasification zone, the improvement which comprises using as the recycle solids inert, refractory pellets which are not fluidized in the gasification zone, passing a hot stream of said pellets through said gasification zone to provide the heat for the gasification reaction, withdrawing said stream, separating entrained carbon from the pellets and returning said separated carbon to the gasification zone charging the separated pellets into a heating zone along with the carbon-containing fines and enough oxidizing gas to burn the carbon-containing fines, maintaining the pellets in the heating zone for a time sufficient to raise their temperature to a point where they provide the heat of reaction in the gasifier, and recirculating the heated pellets back to the gasifier.

2. The process of claim 1 wherein the solid consisting primarily of carbon is coal char.

3. The process of claim 1 wherein the refractory pebbles are made from coal ash.

4. The process of claim 1 wherein the fines are burned in the presence of said separated pellets while said pellets are fluidized in a fluidized bed.

* * * * *